United States Patent [19]

Quan

[11] Patent Number: 4,952,895

[45] Date of Patent: Aug. 28, 1990

[54] PLANAR AIRSTRIPLINE-STRIPLINE MAGIC-TEE

[75] Inventor: Clifton Quan, Arcadia, Calif.

[73] Assignee: Hughes Aircraft Company, Los Angeles, Calif.

[21] Appl. No.: 407,520

[22] Filed: Sep. 15, 1989

[51] Int. Cl.[5] ..... H01P 5/20

[52] U.S. Cl. ..... 333/121; 333/26; 333/128

[58] Field of Search ..... 333/121, 128, 26

[56] References Cited

U.S. PATENT DOCUMENTS

| | | | |
|---|---|---|---|
| 3,497,832 | 2/1970 | Cohn | 333/121 |
| 3,946,339 | 3/1976 | Oltman, Jr. et al. | 333/121 |
| 4,383,227 | 5/1983 | de Ronde | 333/121 |

*Primary Examiner*—Paul Gensler

*Attorney, Agent, or Firm*—Leonard A. Alkov; Wanda K. Denson-Low

[57] ABSTRACT

A multilayer, multiconductor stripline magic-tee network is disclosed. The device incorporates a stripline balun that is sandwiched within a double-sided airstripline 3-port reactive-tee power divider to produce a matched 4-port magic-tee that is physically planar and electrically symmetrical. Each port of the device is shielded from the others.

9 Claims, 3 Drawing Sheets

PLANAR AIRSTRIPLINE-STRIPLINE MAGIC-TEE

BACKGROUND OF THE INVENTION

The present invention relates to microwave devices, and more particularly to a magic tee network having superior amplitude and phase tracking characteristics, lower RF losses and better isolation than conventional stripline networks, and which is smaller and more compact than a waveguide magic-tee network.

Magic-tee devices are well known in the microwave arts. These are four port devices having the characteristic that input power provided at a device input port will be equally divided between two output ports but 180° out of phase.

One common implementation of the magic-tee is as a waveguide magic-tee. Waveguide magic-tee devices are bulky and have a relatively narrow bandwidth.

Another magic-tee implementation is in the form of stripline ratrace hybrids. These devices are generally offer non-symmetrical performance over a relatively narrower bandwidth.

Magic-tees are also implemented in the form of a stripline quadrature coupler with a 90° delay line. These types of devices have the disadvantages of non-symmetrical operation and limited performance over a wide bandwidth.

Other implementations of magic-tee devices include stripline asymmetrical couplers, which have poor phase tracking across a wide frequency band, and microstrip/-slotline magic-tees, wherein the respective ports are not shielded from each other.

It would therefore be an advantage to provide a magic-tee device which is compact, wideband and electrically symmetrical.

It would further be advantageous to provide a magic tee device which is physically planar and electrically symmetrical, and wherein each port of the device is shielded from the others.

SUMMARY OF THE INVENTION

A planar magic tee network device is described, employing a combination of stripline and double-sided airstripline circuits. In a preferred form, the device comprises first and second planar dielectric boards, each comprising first and second planar surfaces. The device further comprises means for sandwiching the dielectric boards together so that the first surfaces of the boards are adjacent each other.

Matching airstripline conductive patterns are formed on the respective second surfaces of the dielectric boards facing outwardly from the sandwiched boards to comprise a double-sized airstripline reactive-tee power divider circuit. The circuit comprises an airstripline input port and two opposed output ports, whereby RF power entering the device at the airstripline input port will be divided equally and in phase between the output ports.

The device further comprises means for defining ground plane surfaces for the airstripline surfaces and spaced from the respective second surfaces of each board, thereby defining open regions between the second surfaces and the ground plane surfaces. The electromagnetic field configurations for the airstripline circuit are concentrated in the open regions between the second board surfaces and the ground plane surfaces.

The device further includes a stripline circuit comprising a strip conductor disposed between the respective first surfaces of the dielectric boards between a stripline port and a stripline balun. The electromagnetic field configurations of the stripline circuit are concentrated within the dielectric boards between the airstripline conductors.

A coupling region is defined in the airstripline conductive patterns adjacent the stripline balun to couple RF energy between the balun and the airstripline circuit. RF energy entering the stripline circuit at the stripline port is divided equally between the airstripline output ports but 180° out of phase.

BRIEF DESCRIPTION OF THE DRAWINGS

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

The invention comprises a four port microwave device that functions as a magic-tee network. The preferred embodiment of the invention employs both double-side airstripline and stripline transmission line media to realize this function.

Figure 1A:
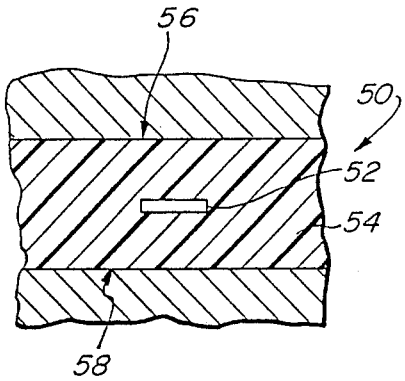
FIGS. 1A and 1B illustrate respectively stripline construction and airline construction techniques.
Figure 1B:
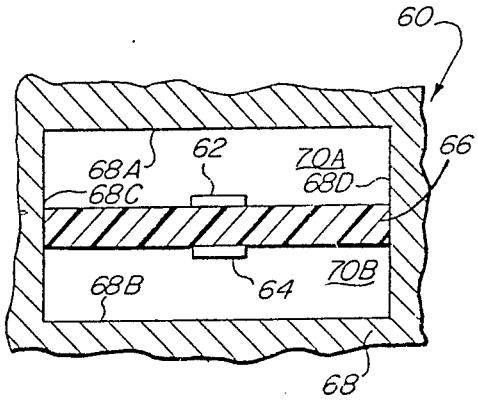

To aid in an understanding of the invention, FIGS. 1A and 1B illustrate conventional stripline and airline construction, respectively. Thus, in FIG. 1A a cross-sectional view of a stripline transmission medium 50 is illustrated, comprising a center conductor strip 52 supported within the dielectric region 54 disposed within the respective ground planes 56 and 58. FIG. 1B shows in cross-section a double-sided airstripline transmission medium 60, wherein the respective strip conductors 62 and 64 are formed on a supporting dielectric board 66. The board 66 is in turn supported within a metal enclosure 68 defining ground planes 68A–68D. Regions 70A and 70B are air regions.

Figure 2A:
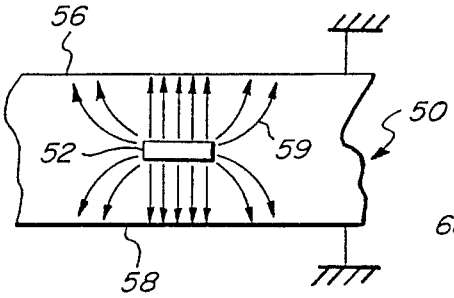
FIG. 2A illustrates the configuration of the electromagnetic field of a stripline.
Figure 2B:
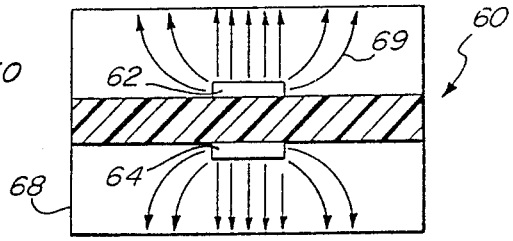
FIG. 2B illustrates the configuration of the electromagnetic field of an airstripline.

FIG. 2A illustrates the configuration of the electromagnetic field for the stripline medium 50, with the field lines 59 illustrating the field configuration. FIG. 2B illustrates the configuration of the electromagnetic field for the airstripline medium 60. The field lines 69 illustrate the field configuration for the airstripline medium.

Figure 3:
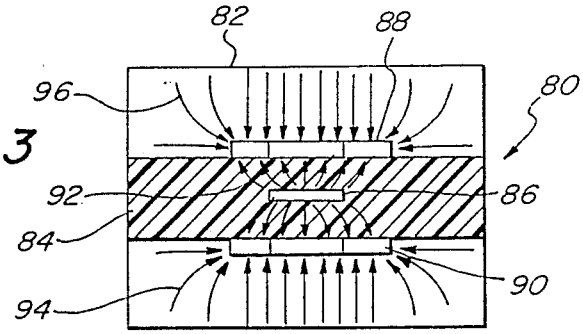
FIG. 3 illustrates the electromagnetic field configurations of a combination of airstripline and stripline transmission line media as employed in the preferred embodiment.

The invention makes use of a combination of the stripline and double-sided airstripline transmission media. FIG. 3 illustrates a cross-sectional view of such a combination structure, and illustrates how these two types of transmission lines can occupy the same physical space and yet be electrically shielded from one another. Thus, the structure 80 comprises a metal enclosure 82 supporting dielectric 84. The center conductor strip 86 of the strip line is supported within the dielectric 84. The airstripline conductors 88 and 90 are formed on opposite sides of the dielectric 84. Field lines 92 represent the electromagnetic field configuration of the stripline portion of the structure 80. Field lines 94 and 96 represent the electromagnetic field configuration of the airstripline portion of the structure 80. It is apparent that the respective electromagnetic fields of the stripline and airstripline portions of the structure 80 are substantially isolated from one another.

Figure 4:
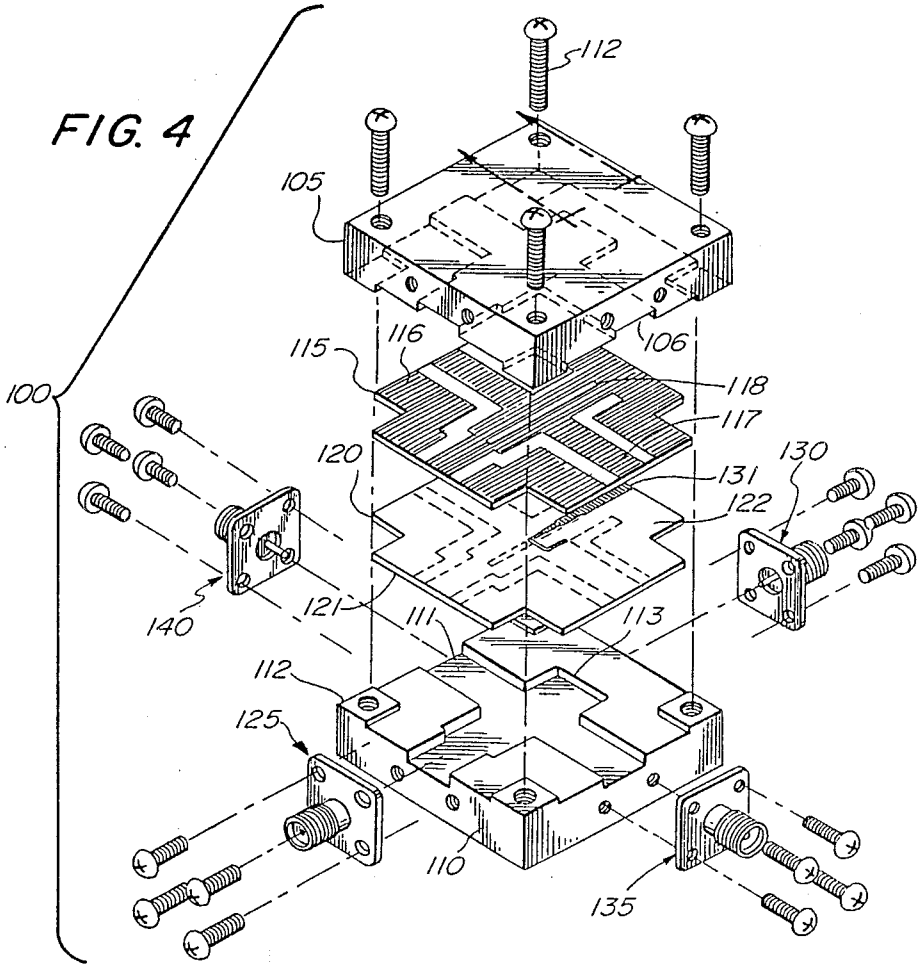
FIG. 4 is an exploded view illustrative of a preferred embodiment of an airline/stripline magic-tee assembly embodying the invention.

FIG. 4 is an exploded perspective view of a preferred embodiment of the four-port device of the invention. The device 100 comprises first and second conductive plate structural members 105 and 110, which may be assembled together by fasteners 112 to sandwich respective first and second dielectric boards 115 and 120. The plates 105 and 110 may be fabricated from aluminum in one preferred form. Each plate 105 and 110 has defined therein a generally tee shaped relieved area. Each plate 105 and 110 further has raised corners which are elevated by a height equal to the thickness of one dielectric board. The corners of the boards 115 and 120 are notched out so that the respective board is fitted with the raised corners of the plate 105 or 110.

The dielectric boards in this embodiment are about 0.020 inches thick, and include selective conductor patterns defined on surfaces thereof. One commercially available dielectric suitable for the purpose is marketed under the name "RT Duroid," by Rogers Corporation, Microwave Materials Division, Chandler, Ariz. The surfaces of the dielectric board are covered with a copper layer, which may be selectively etched away to form a desired conductor pattern by techniques well known to those skilled in the art.

Connectors 125, 130, 135 and 140 provide electrical contact to the stripline and airstripline circuits comprising the device 100, as will be describe in more detail below.

The sum port of the device 100 is at connector 125. The device difference port is at connector 130. The two device output or sidearm ports are at connectors 135 and 140.

The device 100 comprises a double-sided airstripline circuit and a stripline circuit. The airstripline circuit comprises selective conductor patterns (pattern 117 on surface 116 and pattern 123 formed on surface 121) formed on the outside facing surfaces 116 and 121 of the boards 115 and 120. The airstripline circuit further comprises the air regions defined between the respective surfaces 116 and 121 and the relieved areas 106 and 111 of the plates 105 and 110. The conductor pattern 117 on surface 116 is identical to the pattern 123 formed on surface 121. A coupling slot region 118 is formed in the conductor 117 and in the matching conductor pattern 123 on surface 116.

The airstripline circuit is configured as a reactive-tee power divider network. RF power entering into the input port at connector 125 is split equally in phase and amplitude to the two output ports at connectors 135 and 140. Quarter-wavelength impedance transformers are used between the tee junction 150 (FIG. 5) and the output ports at connectors 135 and 140 to provide a good match at the input port. A shorted quarterwave stub is also placed between the impedance matching transformers and the output ports. The stub is physically shorted only in the air-dielectric regions; the dielectric board can then be extended to allow access for the stripline circuit.

Figure 5:
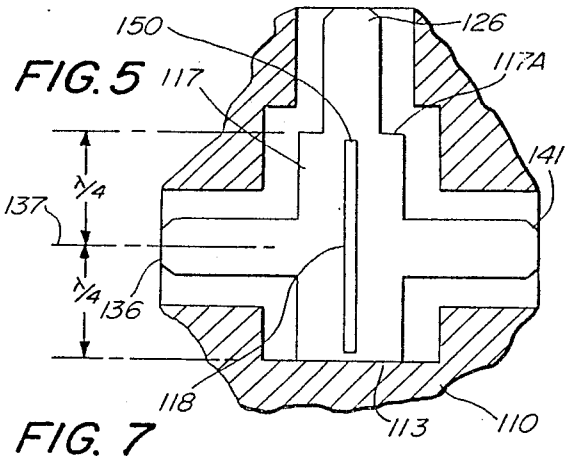
FIG. 5 is a top view of the airline circuit comprising the device of FIG. 4.

FIG. 5 discloses the quarter-wavelength stub and impedance transformers. In this top view, the width of the conductor pattern 117 (and of the corresponding pattern 123 on board 120) at the input port 126 and the two output ports 136 and 141 is selected so that the characteristic impedance of the airstripline circuit at each port is 50 ohms. The width of the conductor pattern 117 is increased at step region 117A to provide, with the coupling region 118, an impedance transformation from 50 ohms to 70.7 ohms. The conductive pattern is terminated at region 113 by contact with the plates 105 and 110. The short circuit termination is one quarter wavelength (at the band center frequency) from the center line 137 of the conductor pattern between the output ports 136 and 141. The impedance transformer step region 117A is also located one quarter wavelength from the center line 137.

Figure 7:
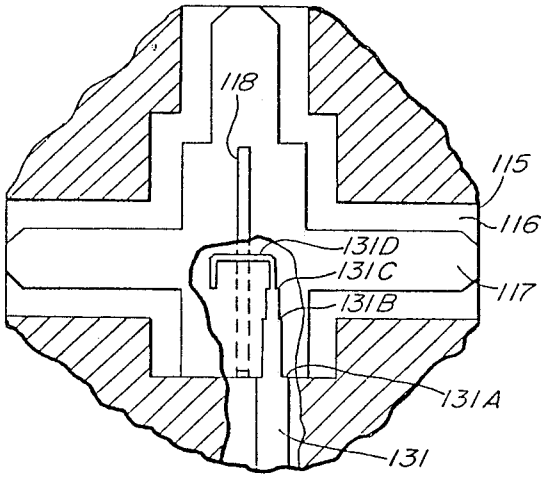
FIG. 7 is a top view of an enlarged portion of the airline and stripline circuit layout comprising the device of FIG. 4.

The fourth port at connector 130 of the device is connected to the stripline circuit sandwiched between the boards 115 and 120 supporting the airstripline circuitry. The stripline circuit comprises the hook-shaped strip conductor 131 formed on the surface 122 of the dielectric board 120 facing the dielectric board 115. The stripline circuit is coupled to the airstripline circuit outputs at connectors 135 and 140 via a balun network and impedance transformers. The balun network is shown in FIG. 7, a partially cutaway view illustrating the airstripline and stripline circuit layout. The width of the strip conductor 131 is stepped down from its initial width, characterized by a 50 ohm characteristic impedance, at steps 131A, 131B and 131C, in a three stage impedance transformation, to a balun strip width at the stripline balun 131D having a characteristic impedance of 100 ohms. Coupling between the stripline and airstripline circuits is provided via the coupling region 118, which is a strip region defined in the conductive pattern 117 in which the conductive layer has been removed. This impedance transformation is used because the impedance presented to the balun network by the airstripline circuit is effectively 100 ohms, since the two output ports at connectors 135 and 140 each have a 50 ohm impedance, and the output port impedances are seen by the balun network in series.

The balun network sets the condition that the two output ports at connectors 135 and 140 will have a voltage potential that is equal in amplitude but 180° out of phase. Thus, RF power entering the stripline port at connector 130 will split equally in amplitude but out of phase to the airstripline outputs at the connectors 135 and 140. Because the airstripline circuit layout is symmetrical, the coupling by the stripline balun network is electrically symmetrical with respect to the two outputs at connectors 135 and 140. Thus, there will be excellent tracking in amplitude and phase between the two outputs at connectors 135 and 140.

Figure 6A:
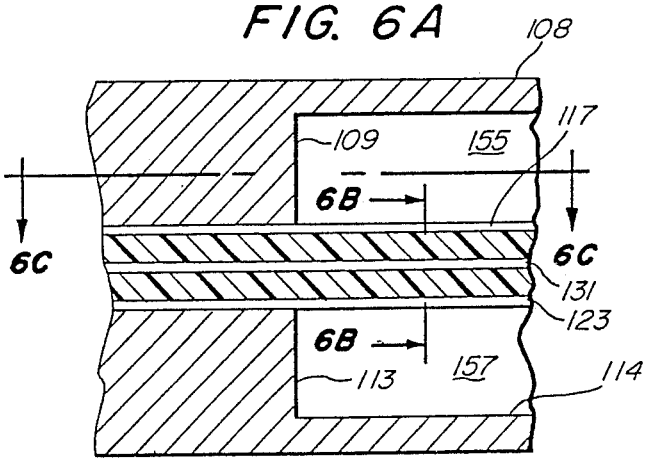
FIGS. 6A–6C are additional views further illustrating the device of FIG. 4.
Figure 6B:
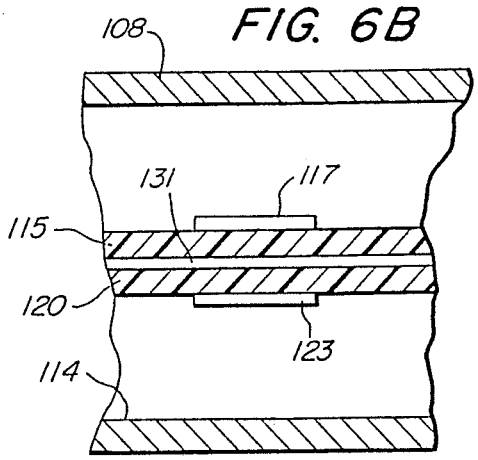
Figure 6C:
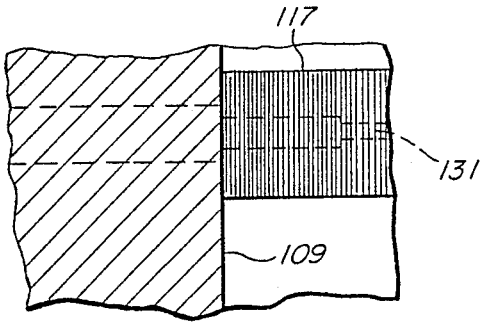

FIGS. 6A–6C illustrate the accessing of the stripline circuit into the airstripline circuit. The plates 105 and 110 sandwich the dielectric boards 115 and 120, with the relieved areas in the plates 105, 110 such as area 111 defining air regions 155 and 157 between the dielectric boards and the respective ground planes 108 and 114 defined by the plates 105 and 110 (FIGS. 6A and 6B).

The airstrip conductor patterns 117 and 123 extend past the air regions and contact the respective metal plates 105 and 110 to provide the short circuit termination at regions 109 and 113. The strip conductor 131 is insulated from the plates 105 and 110, and extends (FIG. 6C) to the edge of the board 120, where contact is made with the connector 130.

The device 100 is unique from other stripline structures in that the two input ports, the sum and difference ports at connectors 125 and 130, are completely isolated from each other. This is achieved in two parts. The first part involves the way the stripline circuit is accessed into the airline circuitry. The fields of the airstripline circuit are concentrated in the air-dielectric regions between the airstripline strips and the ground planes defined by plates 105 and 110, while the fields of the stripline circuit are concentrated within the boards between the airstripline conductor patterns 117 and 123. The second part involves the circuit layout of the device 100. The region 118 where the stripline balun couples to the airstripline circuit is located at a quarter-wavelength away from the airstripline tee junction 150 (FIG. 5) and a quarter wavelength away from the terminated end of the short circuited airstripline stub. Since the short circuited stub is distanced a quarter wavelength away, it will appear to act as an open circuit at the coupling region and will not significantly affect the airstripline circuit except to access the stripline to the coupling region 118. The signal excited from the airstripline input will generate a zero voltage potential across the coupling region since the voltage cf the two halves of the airstripline circuit will be equal in amplitude and phase. Thus, no signal from the airstripline circuit will couple onto the stripline circuit because of this zero voltage potential. A signal excited from the stripline input at connector 130 will generate a voltage potential across the coupling region 118. However, since the voltages of the two halves of the airstripline circuit will be equal in amplitude but opposite in phase, these two voltages will cancel out at the tee junction 150 creating a virtual short circuit at that point. Thus, the signal from the stripline input at connector 130 will be isolated from the airstripline input at connector 125.

By using both the airstripline and stripline transmission line media, the electrical performance of the magic tee device is superior in amplitude and phase tracking compared to other known devices across a wide (octave) bandwidth at microwave frequencies. The network has lower RF losses and better isolation than conventional stripline devices, and is smaller and more compact than a waveguide magic-tee.

The device can perform as well as a waveguide magic-tee with respect to phase and amplitude tracking, plus it has the added advantage of much broader band of frequency operation. In one embodiment, excellent performance has been achieved over the frequency band 6.5 to 11.5 Ghz. The device is planar and compact-like conventional stripline networks; however, this invention is electrically symmetrical and shielded unlike other circuits.

It is understood that the above-described embodiment is merely illustrative of the possible specific embodiments which may represent principles of the present invention. Other arrangements may readily be devised in accordance with these principles by those skilled in the art without departing from the scope of the invention. For example, the dielectric region need not be defined by two separate dielectric boards, but may be formed as an integral unit around the stripline conductor.

What is claimed is:

1. A planar magic tee network device employing stripline and double-sided airstripline circuits, comprising:

means for defining a substantially planar dielectric region characterized by opposed first and second planar surfaces;

matching airstripline conductive patterns formed on said respective first and second surfaces to comprise a double-sided airstripline reactive-tee power divider circuit, comprising an airstripline input port and two opposed output ports, whereby RF power entering the device at the airstripline input port will be divided equally and in phase between the output ports;

means for defining ground plane surfaces for the airstripline circuit and spaced from the respective surfaces of said dielectric region, thereby defining open regions between the second surfaces and the ground plane surfaces whereby the electromagnetic field configurations for said airstripline circuit are concentrated within said open regions between the respective dielectric surfaces and the ground plane surfaces;

a stripline circuit comprising a stripline conductor disposed within said dielectric region intermediate the respective dielectric surfaces between a stripline port and a stripline balun network, wherein the electromagnetic field configurations of the stripline circuit are concentrated within said dielectric region between said airstripline conductors; and means for defining an energy coupling region in said airstripline conductor pattern adjacent said stripline balun network to couple RF energy entering the stripline port into said airstripline circuit;

whereby RF energy entering the device at the stripline port will be divided equally between the airstripline output ports but 180° out of phase.

2. The device of claim 1 wherein said airstripline reactive-tee power divider circuit is characterized by a tee junction, and said stripline balun and coupling region is disposed a quarter-wavelength distance from the tee junction at the center frequency of the frequency band of interest.

3. The device of claim 2 wherein said airstripline circuit further comprises a double-sided quarter-wavelength shorted stub extending from the region at which the stripline balun couples RF energy to the airstripline circuit.

4. The device of claim 1 wherein said means for defining ground plane surfaces for the airstripline circuit comprises first and second metal device housing plates, said plates having relieved, regions formed therein to define said open regions and said ground plane surfaces.

5. The device of claim 4 wherein said dielectric region is sandwiched between said first and second metal housing plates

6. The device of claim 5 further comprising respective strip-conductor-to-coaxial transition devices connected to said strip conductors at said airstripline circuit ports and at said stripline circuit ports.

7. The device of claim 1 wherein said means for defining said dielectric region comprises first and second dielectric boards which are sandwiched together between said ground plane defining means.

8. The device of claim 1 wherein said output ports of said airstripline circuits each are characterized by a characteristic impedance of N ohms, said stripline conductor is characterized by a characteristic impedance of N ohms, and said balun network is characterized by an impedance of 2N ohms, and wherein said stripline circuit further comprises an impedance transformer for transforming the stripline conductor impedance to 2N ohms between the stripline port and said balun network.

9. A planar magic tee network device employing stripline and double-sided airstripline circuits, comprising:

means for defining a substantially planar dielectric region characterized by opposed first and second planar surfaces;

a double-sided airstripline reactive-tee power divider circuit, comprising:

symmetrical airstripline conductive patterns formed on the respective surfaces of said dielectric region in a configuration to comprise a reactive-tee power divider circuit having an input port and two output ports, and a quarter-wavelength stub;

means for short circuiting said stub; and means for defining ground plane surfaces spaced from said dielectric region surfaces to define regions between the dielectric region surfaces and the ground plane surfaces, whereby the electromagnetic field configurations for the airstripline circuit are concentrated within the open regions;

a stripline circuit comprising a balun network and a strip conductor disposed within said dielectric region between the airstripline conductors and intermediate the respective dielectric surface, said strip conductor extending between a stripline port and said balun network, wherein the electromagnetic field configurations of the stripline circuit are concentrated within the dielectric region;

means for defining an RF energy coupling region in the airstripline conductor patterns adjacent the stripline balun network to couple RF energy entering the stripline port into said airstripline circuit;

whereby the airstripline input port and the stripline port are isolated from each other, and RF energy entering the stripline port will be divided equally between the airstripline output ports but 180° out of phase.

* * * * *